United States Patent [19]

Lienart van Lidt de Jeude

[11] Patent Number: 4,558,307

[45] Date of Patent: Dec. 10, 1985

[54] REMINDER DEVICE

[76] Inventor: Roland R. Lienart van Lidt de Jeude, 38 Avenue des Traquets, B-1160 Brussels, Belgium

[21] Appl. No.: 513,021

[22] Filed: Jul. 12, 1983

[30] Foreign Application Priority Data

Sep. 8, 1982 [LU] Luxembourg ..... 84369

[51] Int. Cl.[4] ..... G08B 23/00

[52] U.S. Cl. ..... 340/527; 250/214 AL; 307/590; 315/134; 340/529; 340/530; 340/568; 340/571

[58] Field of Search ..... 340/571, 530, 568, 529, 340/527, 539; 307/590, 597; 250/336.1, 214 AL; 315/134

[56] References Cited

U.S. PATENT DOCUMENTS

| | | | |
|---|---|---|---|
| 2,407,439 | 9/1946 | Olson | 340/568 X |
| 2,519,940 | 8/1950 | Smith et al. | 340/568 X |
| 3,226,705 | 12/1965 | Kaufman et al. . | |
| 3,300,770 | 1/1967 | Brousseau et al. . | |
| 3,428,861 | 2/1969 | Zinsmeyer | 250/214 AL X |
| 3,656,144 | 4/1972 | Forte . | |
| 3,728,675 | 4/1973 | Horn et al. | 340/571 X |
| 3,789,220 | 1/1974 | Schacht | 250/206 |
| 3,797,006 | 3/1974 | Reininger . | |
| 3,815,118 | 6/1974 | McDonald . | |
| 3,889,251 | 6/1975 | Litman | 340/530 |
| 3,909,819 | 9/1975 | Radford . | |
| 3,930,249 | 12/1975 | Steck et al. | 340/571 |
| 3,945,728 | 3/1976 | Crandell | 340/568 X |
| 3,969,709 | 7/1976 | Isaacs et al. | 340/539 X |
| 3,995,268 | 11/1976 | Ferrari | 340/384 E |
| 4,030,087 | 6/1977 | Ritchie et al. . | |
| 4,090,183 | 5/1978 | Miller . | |
| 4,101,873 | 7/1978 | Anderson et al. | 340/539 |
| 4,155,077 | 5/1979 | Rohan et al. | 340/600 X |
| 4,197,461 | 4/1980 | Umbarger et al. . | |
| 4,198,563 | 4/1980 | Elssner | 250/214 AL |
| 4,223,296 | 9/1980 | Kim et al. | 340/568 X |
| 4,242,670 | 12/1980 | Smith | 340/600 X |
| 4,249,160 | 2/1981 | Chilvers | 315/134 X |
| 4,260,982 | 4/1981 | DeBenedictis et al. | 340/568 X |
| 4,291,301 | 9/1981 | Chan | 340/568 |
| 4,294,263 | 10/1981 | Hochman . | |
| 4,327,360 | 4/1982 | Brown | 340/571 |
| 4,362,970 | 12/1982 | Grady | 250/214 AL X |
| 4,399,431 | 8/1983 | Satomi et al. | 340/568 |

FOREIGN PATENT DOCUMENTS

| | | | |
|---|---|---|---|
| 0089667 | 9/1983 | European Pat. Off. | 539/ |
| 2412896 | 8/1979 | France | 340/568 |
| 2423015 | 12/1979 | France | 340/539 |
| 1138517 | 1/1969 | United Kingdom | 340/571 |

*Primary Examiner*—James L. Rowland
*Assistant Examiner*—Thomas J. Mullen, Jr.
*Attorney, Agent, or Firm*—Spencer & Frank

[57] ABSTRACT

A box formed with an aperture in which a photosensitive cell is secured includes an electronic circuit connected to be fed by the electrical signal produced by the photosensitive cell when the latter is irradiated by ambient radiation. Said electronic circuit comprises a delay circuit adapted to receive the signal and arranged to produce a control signal when the cell has been irradiated for a predetermined time interval; an audible signal generator received in the box opposite apertures and connected to produce an audible signal in response to the control signal; and a circuit adapted to interrupt the audible signal after a predetermined time interval so that the audible signal is of predetermined duration.

The box has means for securing it to an object which is required not to be lost accidentally, e.g. keys, a wallet, a diary, etc. A cover can be provided for being placed over the cell to protect it and keep away external radiations when the reminder device is not required to be operative.

4 Claims, 3 Drawing Figures

REMINDER DEVICE

BACKGROUND OF THE INVENTION

The invention relates to a device adapted to be secured to an object to warn the carrier or wearer thereof that he is running the risk of forgetting and abandoning the object in an inappropriate place.

It often happens that articles are placed accidentally on an article of furniture or a counter in a public place and forgotten. Typical examples of this occur frequently with keys, wallets, ball point pens and diaries.

It is the object of the invention to obviate these disadvantages by drawing the attention of the owner of the object to the risk of it being abandoned.

SUMMARY OF THE INVENTION

This object is achieved through the agency of the invention by a reminder device comprising a box formed with an aperture in which a photosensitive cell is secured, the cell being adapted to produce an electrical signal when irradiated by ambient radiation, a delay circuit adapted to receive the signal and arranged to produce a control signal when the cell has been irradiated for a predetermined time interval, an audible signal generator received in the box opposite apertures and connected to produce an audible signal in response to the control signal; and a circuit adapted to interrupt the audible signal after a predetermined time interval so that the audible signal is of predetermined duration.

DESCRIPTION OF THE DRAWINGS

The invention will be described in greater detail hereinafter with reference to the accompanying drawings wherein.

DESCRIPTION OF AN EXEMPLARY EMBODIMENT OF THE INVENTION

Figure 1:
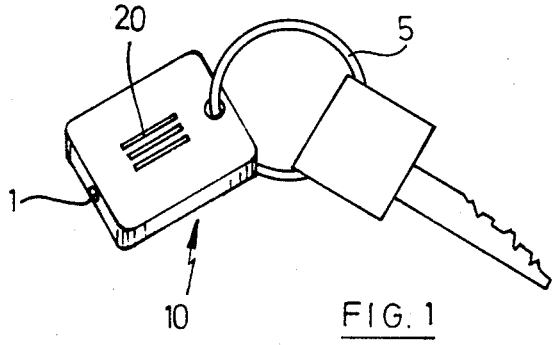
FIG. 1 is a view of an embodiment of a typical construction.
Figure 2:
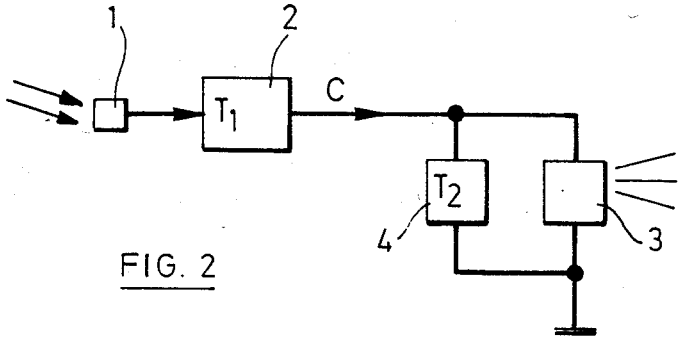
FIG. 2 is a block schematic diagram of the electronic circuit of the device.

Referring to FIG. 1 there is shown a typical embodiment as a key ring holder. The reminder device is comprised of a box 10 made of any desired material and housing an electronic circuitry which is described later herein and, if required, microcells for energizing the electronic circuitry. The box 10 has means for securing it to an object. In the example shown such means are a key ring 5 for holding keys. The box 10 is formed with an aperture receiving a photosensitive cell 1 adapted to be irradiated by ambient light radiations and to produce an electrical signal when thus irradiated. The cell 1 can be, for instance, a photoelectric cell or a solar cell. The electric signal from the cell 1 drives an electronic circuit arranged to produce an audible warning signal which can be heard through slits or apertures 20 formed in the box.

The electronic circuit comprises a delay circuit 2 adapted to receive the electrical signal output by the cell 1 and to produce a control signal C when the cell is irradiated for a predetermined time interval $T_1$, for instance 10 seconds. The control signal C serves to operate an audible signal generator 3 received in the box 10 opposite the apertures 20. The generator 3 reacts to a control signal C by producing an audible warning signal.

Advantageously, the generator 3 is associated with a circuit 4 arranged to interrupt such signal after a predetermined time interval $T_2$, for instance 5 seconds.

Consequently, when the object with which the device is associated is placed anywhere where there is daylight, the irradiated cell 1 operates the audible warning generator 3 after a predetermined time interval $T_1$, such signal warning the person who has left the object. Advantageously, the audible signal is interrupted after a given time interval $T_2$. However, when the object is held in the hand or placed in the pocket or in a bag, i.e. when it is in a secure position no light is incident on the cell 1 and the generator 3 remains inoperative.

Figure 3:
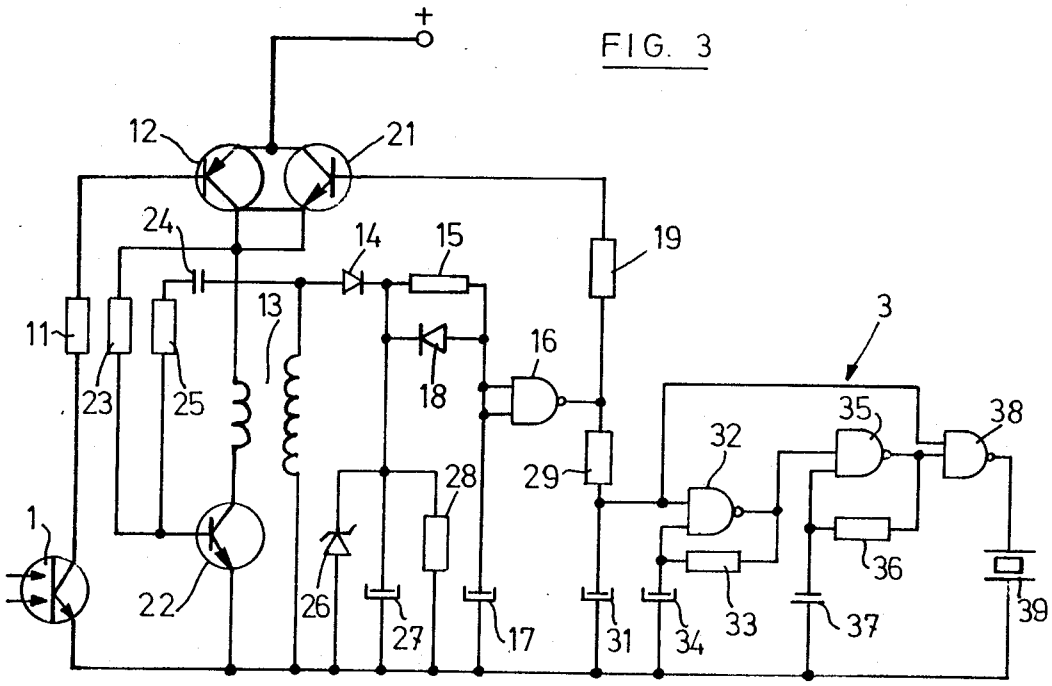
FIG. 3 is a schematic diagram of an exemplary implementation of the electronic circuit of the device according to the invention.

The electronic circuit can be implemented in different ways. FIG. 3 illustrates an exemplary implementation. The reference numeral 1 denotes a phototransistor which is sensitive to daylight irradiation. When the phototransistor 1 is irradiated, it produces a collector signal which is applied through resistor 11 to the base of the amplifier transistor 12 and the output current flows through the primary winding of transformer 13. The secondary winding is connected through diode 14 and the parallel combination of resistor 15 and decoupling diode 18 to the input of gate 16 and across the capacitor 17. The capacitor 17 charges for instance in 10 seconds through resistor 15 and when it is charged, the voltage across it causes gate 16 to switch so that the output thereof switches from its initial logic state 1 to logic state 0 and the capacitor 17 discharges.

As long as the capacitor 17 is charging, the initial output state 1 of gate 16 is fed back through resistor 19 and transistor 21 to keep the output of gate 16 at state 1 until it is switched at the time when capacitor 17 is charged. The voltage across the capacitor 17 is fixed by the Zener diode 26 with the associated resistor 28 and the decoupling capacitor 27. The transistor 22 together with resistor 23 serves to circulate the parasitic signals. Resistor 25 and capacitor 24, coupled in series between the base of transistor 22 and the junction of the secondary of transformer 13 with diode 14, are decoupling elements.

The control signal C at the output of gate 16 operates the quartz crystal generator 39 through resistor 29 and output gate 38. Meanwhile the control signal C charges the capacitor 31 in for instance 5 seconds and when this capacitor is charged the voltage across it starts an inhibit circuit comprised of gates 32 and 35 with the associated circuit elements 33, 34, 36, 37. The output of gate 35 is connected to a second input of the output gate 38 thereby to inhibit the control signal and consequently interrupt the audible warning signal after a predetermined time.

The reminder device according to the invention can of course be embodied in different shapes and constructional variants to suit particular applications and can be secured to any object which is required not to be lost accidentally. In one particular embodiment, the securing means can take the form of a self-adhesive member secured to a surface of the box 10 to stick the same to the surface of an object, for instance, a wallet.

The box 10 can have a cover which can be placed over the cell 1 to protect it and keep away external radiations when the device is not required to be operative.

What is claimed is:

1. A reminder device adapted to be secured to an object comprising a box formed with an aperture in which a photosensitive cell is secured, said cell being adapted to produce an electrical signal when irradiated by ambient radiation;

amplifier means having its input connected to the output of said photosensitive cell;

electric transformer means having a primary winding connected to be fed by the output signal of said amplifier means and having a secondary winding;

first delay means connected across the secondary winding of said transformer means;

logic gate means connected to said first delay means to be switched by the output signal from the delay means to provide a control signal;

output gate means having a first input connected to accept said control signal and a second input, said output gate means having its output connected to an audible signal generator;

second delay means connected across the output of said logic gate means;

switching means having its input connected to said second delay means and having its output connected to the second input of said output gate means, said switching means being responsive to the output signal from said second delay means to inhibit the control signal for said audible signal generator thereby interrupting the audible warning signal after a predetermined interval of time.

2. A device according to claim 1, wherein the box comprises means for securing the device to an object.

3. A device according to claim 1, wherein the box has on its surface means for sticking the device to an object.

4. A key ring holder with reminder device, comprising a reminder device according to claim 1 and a key ring secured to the box of the device.

* * * * *